US008517463B2

(12) United States Patent
Murphy et al.

(10) Patent No.: US 8,517,463 B2
(45) Date of Patent: Aug. 27, 2013

(54) GLIDING-RECLINING LAYFLAT SEATING UNIT WITH POWER ACTUATOR AND MANUAL AND AUTOMATIC LOCKING LINKAGES

(75) Inventors: Marcus L. Murphy, Lexington, NC (US); D. Stephen Hoffman, High Point, NC (US)

(73) Assignee: Ultra-Mek, Inc., Denton, NC (US)

( * ) Notice: Subject to any disclaimer, the term of this patent is extended or adjusted under 35 U.S.C. 154(b) by 360 days.

(21) Appl. No.: 12/942,389

(22) Filed: Nov. 9, 2010

(65) Prior Publication Data

US 2012/0112519 A1 May 10, 2012

(51) Int. Cl.
*A47C 1/02* (2006.01)
*A47C 3/03* (2006.01)

(52) U.S. Cl.
USPC ..... 297/84; 297/69; 297/270.1

(58) Field of Classification Search
USPC ..... 297/261.1, 270.1, 85 M, 69, 83, 297/84, DIG. 7
See application file for complete search history.

(56) References Cited

U.S. PATENT DOCUMENTS

| | | | | |
|---|---|---|---|---|
| 4,212,494 | A * | 7/1980 | Dabney | 297/69 |
| 4,949,408 | A * | 8/1990 | Trkla | 5/86.1 |
| 5,704,686 | A * | 1/1998 | May | 297/281 |
| 5,865,457 | A | 2/1999 | Knabusch et al. | |
| 5,868,461 | A | 2/1999 | Brotherston | |
| 6,120,095 | A * | 9/2000 | Rogers | 297/273 |
| 6,154,899 | A | 12/2000 | Brooke et al. | |
| 7,114,770 | B2 | 10/2006 | Murphy | |

* cited by examiner

*Primary Examiner* — Sarah B McPartlin
(74) *Attorney, Agent, or Firm* — Myers Bigel Sibley & Sajovec, P.A.

(57) ABSTRACT

A gliding and reclining seating unit includes: a base; a generally horizontally-disposed seat; a generally upright backrest positioned above the base and substantially rearward of the seat; an extendable ottoman; a reclining mechanism attached to the seat, the backrest, the ottoman and the base; and a gliding mechanism attached to the base and the reclining mechanism. The seating unit further comprises: a manually-operated lock linkage that moves between an unlocked condition, in which the linkage permits the seating unit to glide and a locked condition, in which the seating unit is prevented from gliding; and an automatic lock linkage coupled to the reclining mechanism, the automatic lock linkage configured to move between an unlocked condition that allows the seating unit to glide when it is in the upright position and a locked condition that prevents the seating unit from gliding when it is in the fully reclined position.

22 Claims, 11 Drawing Sheets

GLIDING-RECLINING LAYFLAT SEATING UNIT WITH POWER ACTUATOR AND MANUAL AND AUTOMATIC LOCKING LINKAGES

FIELD OF THE INVENTION

This invention relates generally to seating units, and relates more particularly to reclining seating units with rocking capability.

BACKGROUND OF THE INVENTION

Recliner chairs and other reclining seating units have proven to be popular with consumers. These seating units typically move from an upright position, in which the backrest is generally upright, to one or more reclined positions, in which the backrest pivots to be less upright. The movement of the seating unit between the upright and reclined positions is typically controlled by a pair of matching reclining mechanisms that are attached to the seat, backrest and base of the chair.

In recent years, furniture designers have looked for alternatives to rocking chairs that can provide a similarly relaxing repetitive motion. One alternative has been the gliding chair, or "glider", which includes structure that enables the seat portion of the chair to "glide" forwardly and rearwardly relative to its base to mimic generally the rocking motion of a rocking chair. Often the gliding structure comprises a set of swing links (usually two at the front of the chair, and two at the rear) that are pivotally attached at their upper ends to the base and extend downwardly therefrom to attach to a structure, such as a mounting bracket, that is attached to the seat. In this configuration, the seat is suspended from the base and is free to swing forwardly and rearwardly in a double pendulum-type motion in response to a forwardly or rearwardly-directed force applied by a seated occupant. The gliding path of the chair is controlled by the configuration and mounting of the swing links. These chairs can be constructed to resemble traditional rocking chairs and thus are quite popular.

Reclining capability has been combined with gliding capability in a single unit to provide a chair that both reclines and glides. This chair includes a reclining mechanism that enables it to move between upright and one or more reclined positions, and further includes the aforementioned swing links attached between the base and the seat, armrests, or mechanism itself to enable the chair to glide. Examples of such chairs are illustrated and described in U.S. Pat. Nos. 4,536,029 and 4,544,201, both to Rogers, Jr., the disclosures of which are hereby incorporated herein by reference in their entireties.

Although they are already popular seating units, it may be desirable to provide additional functionality to glider-recliners.

SUMMARY OF THE INVENTION

As a first aspect, embodiments of the present invention are directed to a gliding and reclining seating unit. The gliding and reclining seating unit comprises: a base configured to reside on an underlying surface; a generally horizontally-disposed seat positioned above the base; a generally upright backrest positioned above the base and substantially rearward of the seat; an extendable ottoman; a reclining mechanism attached to the seat, the backrest, the ottoman and the base unit; and a gliding mechanism attached to the base unit and the reclining mechanism. The reclining mechanism comprises a plurality of pivotally interconnected links and includes (a) an ottoman linkage configured to move the ottoman between a retracted position, in which the ottoman is generally vertically disposed and positioned below the seat, and an extended position, in which the ottoman is generally horizontally disposed in front of the seat, and further includes (b) a backrest linkage configured to move the backrest and seat between an upright position, in which the seat is generally horizontally disposed and the backrest is generally vertically disposed, and a fully reclined position, in which the angle between the backrest and the seat increases. The gliding mechanism is configured to enable the seat, backrest and reclining mechanism to glide relative to the base unit along a longitudinal path responsive to a longitudinally-directed force. The seating unit further comprises: a manually-operated lock linkage that moves between an unlocked condition, in which the linkage permits the seating unit to glide, and a locked condition, in which the seating unit is prevented from gliding; and an automatic lock linkage coupled to the reclining mechanism, the automatic lock linkage configured to move between an unlocked condition that allows the seating unit to glide when it is in the upright position and a locked condition that prevents the seating unit from gliding when it is in the fully reclined position.

As a second aspect, embodiments of the present invention are directed to a gliding and reclining seating unit, comprising: a base configured to reside on an underlying surface; a generally horizontally-disposed seat positioned above the base; a generally upright backrest positioned above the base and substantially rearward of the seat; an extendable ottoman; a reclining mechanism attached to the seat, the backrest, the ottoman and the base unit; a gliding mechanism attached to the base unit and the reclining mechanism; a first power unit connected with the ottoman linkage that moves the ottoman from the retracted position to the extended position; and a second power unit connected with the backrest linkage that moves the backrest from the upright position to the fully reclined position. The reclining mechanism comprises a plurality of pivotally interconnected links and includes (a) an ottoman linkage configured to move the ottoman between a retracted position, in which the ottoman is generally vertically disposed and positioned below the seat, and an extended position, in which the ottoman is generally horizontally disposed in front of the seat, and further includes (b) a backrest linkage configured to move the backrest and seat between an upright position, in which the seat is generally horizontally disposed and the backrest is generally vertically disposed, and a fully reclined position, in which the angle between the backrest and the seat increases. The gliding mechanism is configured to enable the seat, backrest and reclining mechanism to glide relative to the base unit along a longitudinal path responsive to a longitudinally-directed force. The seating unit further comprises: a manually-operated lock linkage that moves between an unlocked condition, in which the linkage permits the seating unit to glide, and a locked condition, in which the seating unit is prevented from gliding; and an automatic lock linkage coupled to the reclining mechanism, the automatic lock linkage configured to move between an unlocked condition that allows the seating unit to glide when the backrest is in the upright position and a locked condition that prevents the seating unit from gliding when the backrest is in the fully reclined position.

As a third aspect, embodiments of the present invention are directed to a gliding and reclining seating unit, comprising: a base configured to reside on an underlying surface; a generally horizontally-disposed seat positioned above the base; a generally upright backrest positioned above the base and substantially rearward of the seat; an extendable ottoman; a reclining mechanism attached to the seat, the backrest, the ottoman and the base unit; and a gliding mechanism attached to the base unit and the reclining mechanism. The reclining mechanism comprises a plurality of pivotally interconnected links and includes (a) an ottoman linkage configured to move the ottoman between a retracted position, in which the ottoman is generally vertically disposed and positioned below the seat, and an extended position, in which the ottoman is generally horizontally disposed in front of the seat, and further includes (b) a backrest linkage configured to move the backrest and seat between an upright position, in which the seat is generally horizontally disposed and the backrest is generally vertically disposed, and a fully reclined position, in which the angle between the backrest and the seat increases. The gliding mechanism is configured to enable the seat, backrest and reclining mechanism to glide relative to the base unit along a longitudinal path responsive to a longitudinally-directed force. A rear end portion of the seat rises relative to the base when the backrest moves to the fully reclined position. In the fully reclined position, the backrest defines an angle of between about 0 and 20 degrees with the underlying surface.

As a fourth aspect, embodiments of the present invention are directed to a gliding and reclining seating unit, comprising: a base configured to reside on an underlying surface; a generally horizontally-disposed seat positioned above the base; a generally upright backrest positioned above the base and substantially rearward of the seat; an extendable ottoman; a reclining mechanism attached to the seat, the backrest, the ottoman and the base unit; and a gliding mechanism attached to the base unit and the reclining mechanism. The reclining mechanism comprises a plurality of pivotally interconnected links and includes (a) an ottoman linkage configured to move the ottoman between a retracted position, in which the ottoman is generally vertically disposed and positioned below the seat, and an extended position, in which the ottoman is generally horizontally disposed in front of the seat, and further includes (b) a backrest linkage configured to move the backrest and seat between an upright position, in which the seat is generally horizontally disposed and the backrest is generally vertically disposed, and a fully reclined position, in which the angle between the backrest and the seat increases. The gliding mechanism is configured to enable the seat, backrest and reclining mechanism to glide relative to the base unit along a longitudinal path responsive to a longitudinally-directed force. The seating unit further comprises: a manually-operated lock linkage that moves between an unlocked condition, in which the linkage permits the seating unit to glide, and a locked condition, in which the seating unit is prevented from gliding; and an automatic lock linkage coupled to the reclining mechanism, the automatic lock linkage configured to move between an unlocked condition that allows the seating unit to glide when the backrest is in the upright position and a locked condition that prevents the seating unit from gliding when the backrest is in the fully reclined position.

DETAILED DESCRIPTION OF EMBODIMENTS OF THE INVENTION

Figure 1:
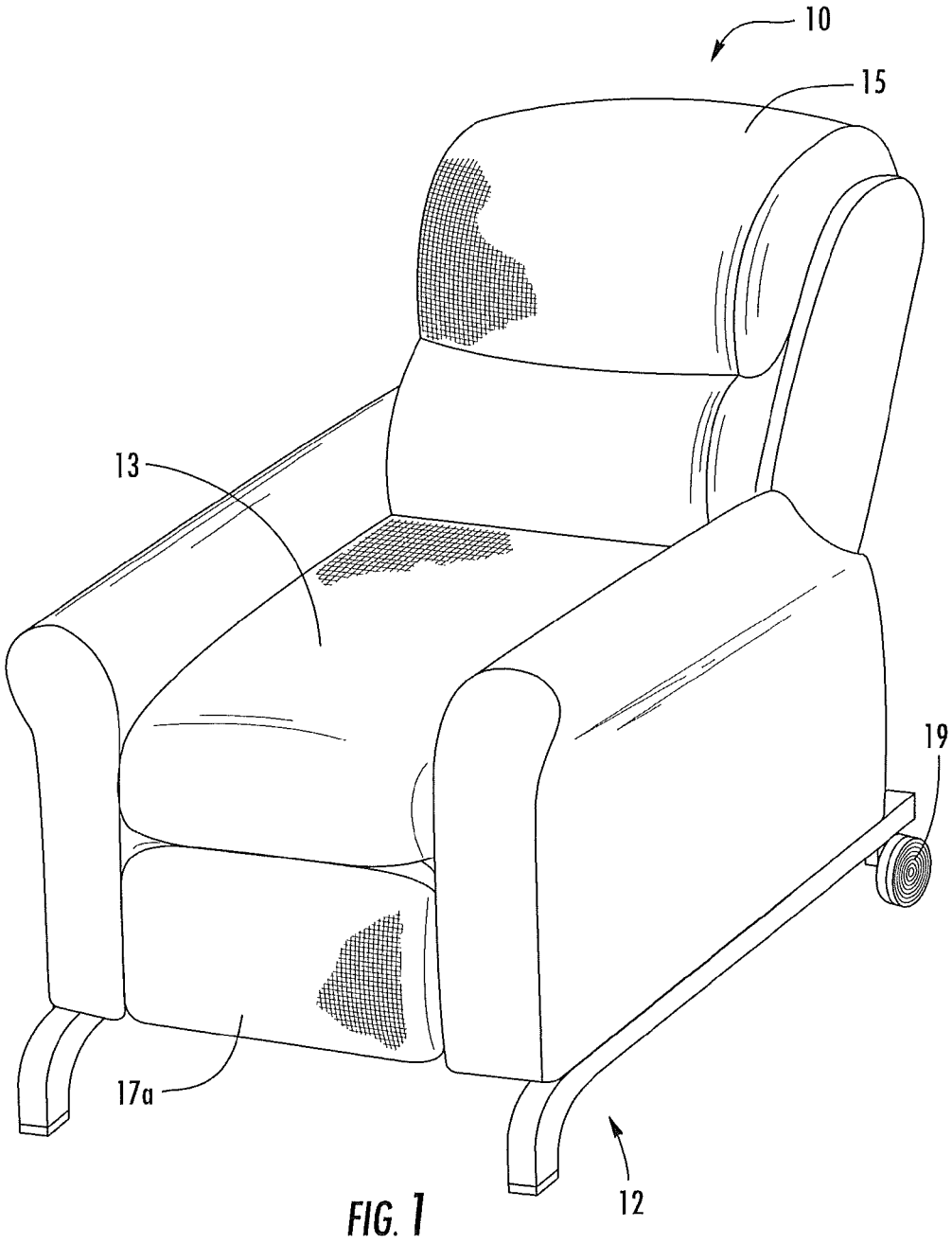
FIG. 1 is a perspective view of a glider-recliner lay-flat chair according to embodiments of the present invention.

The present invention now is described more fully hereinafter with reference to the accompanying drawings, in which embodiments of the invention are shown. This invention may, however, be embodied in many different forms and should not be construed as limited to the embodiments set forth herein; rather, these embodiments are provided so that this disclosure will be thorough and complete, and will fully convey the scope of the invention to those skilled in the art.

Like numbers refer to like elements throughout. In the figures, the thickness of certain lines, layers, components, elements or features may be exaggerated for clarity. Broken lines illustrate optional features or operations unless specified otherwise.

The terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof. As used herein, the term "and/or" includes any and all combinations of one or more of the associated listed items. As used herein, phrases such as "between X and Y" and "between about X and Y" should be interpreted to include X and Y. As used herein, phrases such as "between about X and Y" mean "between about X and about Y." As used herein, phrases such as "from about X to Y" mean "from about X to about Y."

Unless otherwise defined, all terms (including technical and scientific terms) used herein have the same meaning as commonly understood by one of ordinary skill in the art to which this invention belongs. It will be further understood that terms, such as those defined in commonly used dictionaries, should be interpreted as having a meaning that is consistent with their meaning in the context of the specification and relevant art and should not be interpreted in an idealized or overly formal sense unless expressly so defined herein. Well-known functions or constructions may not be described in detail for brevity and/or clarity.

It will be understood that when an element is referred to as being "on", "attached" to, "connected" to, "coupled" with, "contacting", etc., another element, it can be directly on, attached to, connected to, coupled with or contacting the other element or intervening elements may also be present. In contrast, when an element is referred to as being, for example, "directly on", "directly attached" to, "directly connected" to, "directly coupled" with or "directly contacting" another element, there are no intervening elements present. It will also be appreciated by those of skill in the art that references to a structure or feature that is disposed "adjacent" another feature may have portions that overlap or underlie the adjacent feature.

This invention is directed to seating units that have a stationary base, a seat portion, and a backrest. As used herein, the terms "forward", "forwardly", and "front" and derivatives thereof refer to the direction defined by a vector extending from the backrest toward the seat parallel to the underlying surface. Conversely, the terms "rearward", "rearwardly", and derivatives thereof refer to the direction directly opposite the forward direction; the rearward direction is defined by a vector that extends from the seat toward the backrest parallel to the underlying surface. The terms "lateral," "laterally", and derivatives thereof refer to the direction parallel with the floor, perpendicular to the forward and rearward directions, and extending away from a plane bisecting the seating units between their armrests. The terms "medial," "inward," "inboard," and derivatives thereof refer to the direction that is the converse of the lateral direction, i.e., the direction parallel with the floor, perpendicular to the forward direction, and extending from the periphery of the seating units toward the aforementioned bisecting plane.

The seating units illustrated and described herein comprise a plurality of pivotally interconnected links. Those skilled in this art will appreciate that the pivots between links can take a variety of configurations, such as pivot pins, rivets, bolt and nut combinations, and the like, any of which would be suitable for use with the present invention. Also, the shapes of the links may vary as desired, as may the locations of certain of the pivots. Moreover, in some instances combinations of pivot points may be replaced by equivalent structures, such as "slider-crank" configurations, like those described in B. Paul, *Kinematics and Dynamics of Planar Machinery* 4-21 (1979).

Figure 3:
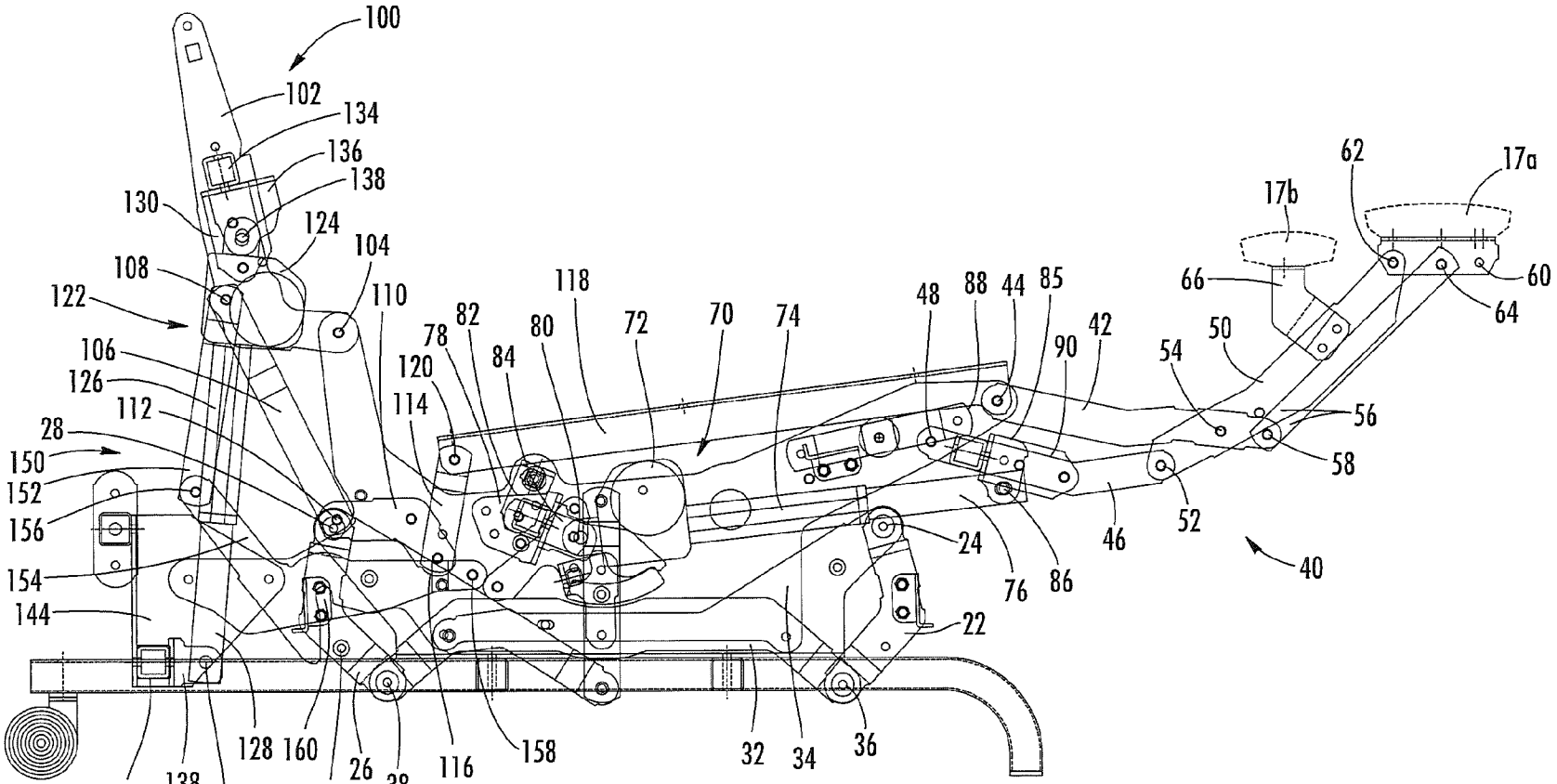
FIG. 3 is a side section view of the chair of FIG. 1 in a "TV" position, with the backrest upright and the ottomans extended.

Referring now to the drawings, a gliding, reclining layflat chair, designated broadly at 10, is illustrated in FIG. 1. The chair 10 includes a base 12, a seat 13, a backrest 15, and front and rear ottomans 17*a*, 17*b* (FIG. 3). These components are interconnected by a pair of gliding linkages 20 and a pair of reclining mechanisms 30 (FIG. 4), each of which includes an ottoman linkage 40 and a backrest linkage 100. All of the components are described in greater detail below.

Figure 2:
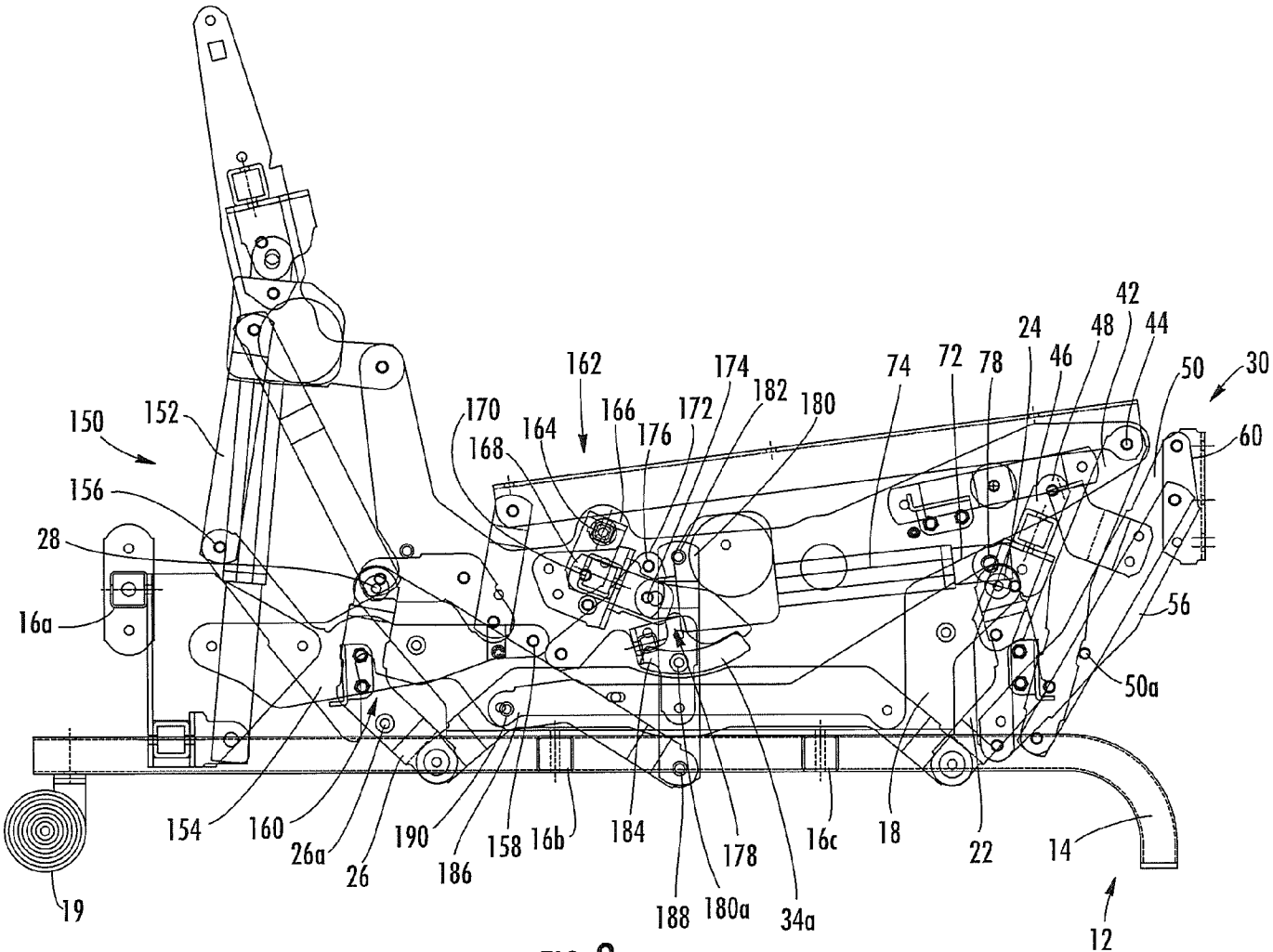
FIG. 2 is a side section view of the chair of FIG. 1 with the backrest in its fully upright position and the ottomans retracted.
Figure 5:
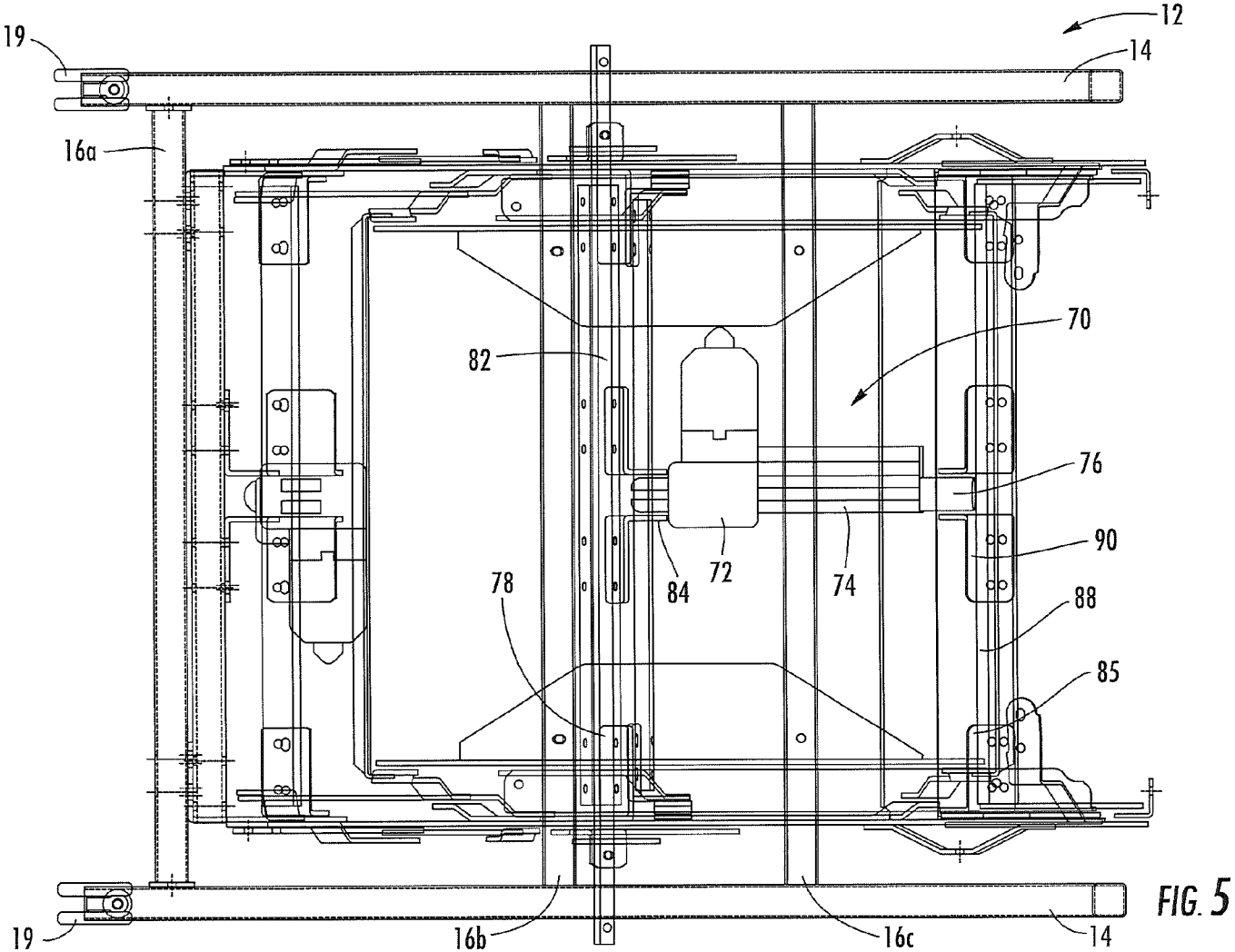
FIG. 5 is a top cutaway view of the frame of the chair of FIG. 1.
Figure 6:
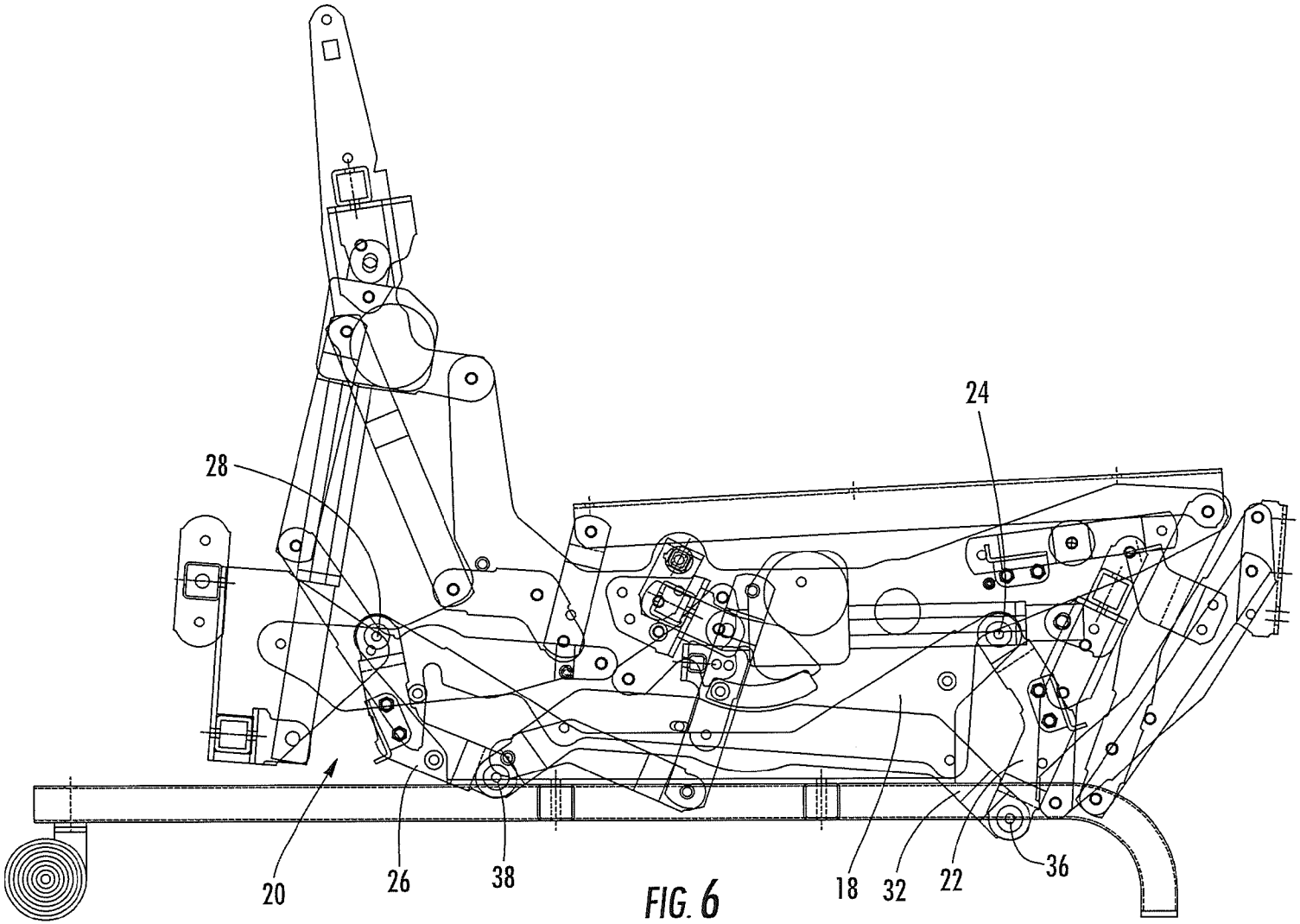
FIG. 6 is a side section view of the chair of FIG. 1 with the backrest in its upright position and the ottomans retracted, wherein the chair has glided forwardly.
Figure 7:
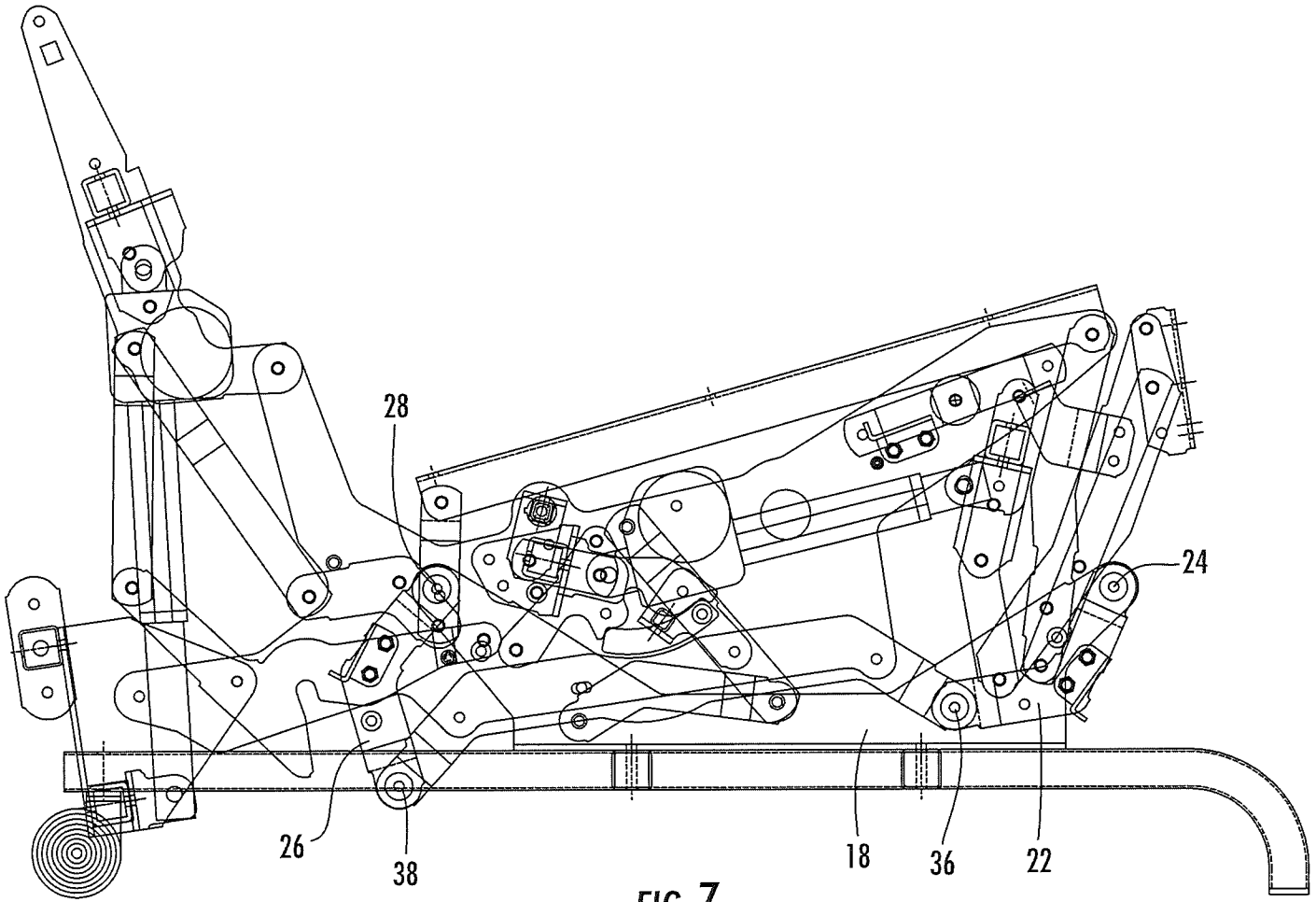
FIG. 7 is a side section view of the chair of FIG. 1 with the backrest in its upright position and the ottomans retracted, wherein the chair has glided rearwardly.

Referring to FIGS. 1, 2 and 5, the base 12 includes a pair of longitudinally-directed rails 14 that are spanned by two cross-members 16*b*, 16*c*. In this embodiment, the base 12 has two casters 19 attached to the rear ends of the rails 14. A glide mounting bracket 18 is mounted on the cross-members 16*b*, 16*c* and extends upwardly therefrom.

Referring now to FIG. 2, each of the gliding linkages 20 includes a front glide link 22 that is pivotally attached to the glide mounting bracket 18 at a pivot 24, and further includes a rear glide link 26 that is pivotally attached to the glide mounting bracket 18 at a pivot 28. The rear glide link 26 includes a pin 26*a*.

Figure 4:
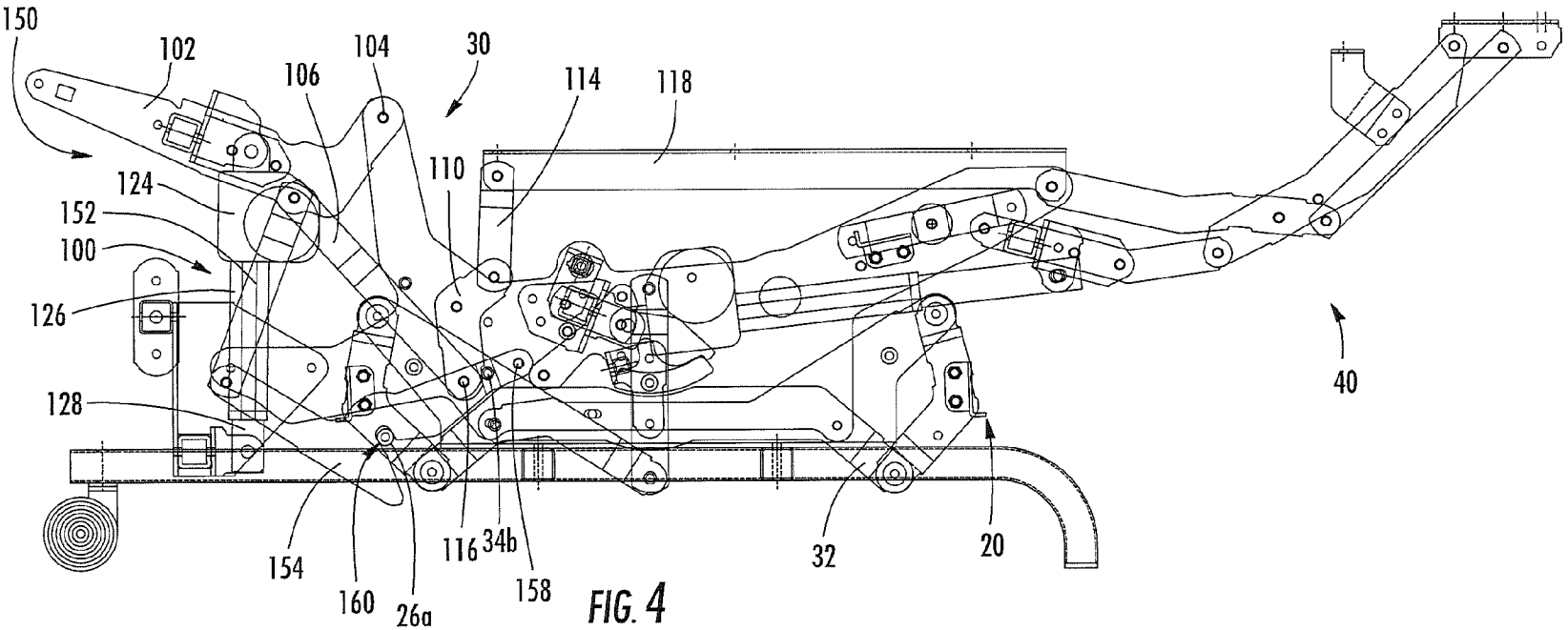
FIG. 4 is a side section view of the chair of FIG. 1 with the backrest in its fully reclined position and the ottomans extended.

The reclining mechanisms 30 are configured such that the ottoman linkage 40 moves the front and rear ottomans 17*a*, 17*b* between a retracted position (as shown in FIG. 2) and an extended position (as shown in FIG. 3—sometimes referred to as the "TV" position—and in FIG. 4). The backrest linkage 100 moves the backrest 15 between an upright position (as in FIGS. 2 and 3) and a fully reclined position (FIG. 4). For clarity, the reclining mechanisms 30 will be described first with respect to the TV position of FIG. 3 (with the ottomans 17*a*, 17*b* extended and the backrest 15 upright), then will be described with respect to the other positions.

The reclining mechanisms 30 are mirror images of each other about a vertical plane that passes through the center of the seat 13 and backrest 15. As such, only one reclining mechanism 30 will be described herein, with the understanding that the discussion is equally applicable to the other reclining mechanism 30.

Referring now to FIG. 3, the reclining mechanism 30 includes a lower mounting member 32 with front and rear arms. The front glide link 22 is attached to the front arm of the lower mounting member 32 at a pivot 36, and the rear glide link 26 is attached to the rear arm of the lower mounting member 32 at a pivot 38, such that the lower mounting member 32 is suspended from the front and rear glide links 22, 26. The lower mounting member 32 is fixed to an upper mounting member 34 that provides a number of mounting locations for links of the reclining mechanism 30.

The ottoman linkage 40 is attached to the forward portion of the upper mounting member 34. An upper ottoman swing link 42 is attached to the upper end of the upper mounting member 34 at a pivot 44 and extends generally forwardly therefrom. A lower ottoman swing link 46 is attached to the upper mounting member 34 at a pivot 48 and extends generally forwardly therefrom, the pivot 48 being positioned downwardly from the pivot 44. An upper ottoman extension link 50 is attached to the lower ottoman swing link 46 at a pivot 52 and to the upper ottoman swing link 42 at a pivot 54. A lower ottoman extension link 56 is attached to the upper ottoman swing link 42 at a pivot 58. The upper and lower ottoman extension links 50, 56 extend upwardly and forwardly generally parallel with each other to pivots 62, 64 with a front ottoman bracket 60, to which is mounted the front ottoman 17*a*. A rear ottoman bracket 66 is fixed to the upper ottoman extension link 50 and extends generally upwardly therefrom; the rear ottoman 17*b* is fixed to the upper surface of the rear ottoman bracket 66.

Still referring to FIG. 3, an ottoman drive unit 70 includes a motor 72, a sleeve 74 that is attached to the motor 72, and a rod 76 that retracts within and extends from the sleeve 74. A mounting bracket 78 is fixed to the upper mounting member 34. A cross-member 82 is fixed to and spans the mounting brackets 78 of each reclining mechanism 30. A mounting bracket 84 is fixed to the cross-member 82 and extends generally forwardly therefrom to a pivot 80 with the motor 72. A bracket 90 is fixed to the lower ottoman swing link 46. A cross-member 88 is fixed to and spans the brackets 90 of each reclining mechanism 30. A bracket 85 is fixed to the cross-member 88 and is attached to the rod 76 at a pivot 86. In the TV position of FIG. 3, the rod 76 is extended from the sleeve 74.

Referring again to FIG. 3, the backrest mechanism 100 includes a backpost 102 that is fixed to the backrest 15. The backpost 102 is attached to a rear finger of the upper mounting member 34 at a pivot 104. A connecting link 106 is attached to the backpost 102 at a pivot 108 and extends downwardly and forwardly therefrom. An angled transition link 110 is attached to the lower end of the connecting link 106 at a pivot 112. The transition link 110 extends forwardly and slightly downwardly from the pivot 112. A seat elevation link 114 is attached to the transition link 110 at a pivot 116 and extends generally upwardly therefrom. A seat frame 118 that underlies the seat 13 is attached at its rear end to the seat elevation link 114 at a pivot 120 and to the upper mounting member 34 at the pivot 44 shared with the upper ottoman swing link 42.

A backrest power unit 122 includes a motor 124, a sleeve 126 and a retractable rod 128. The motor 124 is attached to a bracket 136 at a pivot 138. The bracket 136 is fixed to a cross-member 134 that spans two brackets 130 attached to the backposts 102 of the respective reclining mechanisms 30. The rod 128 is attached at a bracket 138 at a pivot 140. The bracket 138 is fixed to a cross-member 142 that spans two brackets 144 that are fixed to the rear end of the upper mounting member 34. An additional cross-member 16*a* spans the brackets 144 and extends laterally therefrom to brackets 148, which are mounted onto the arms of the chair 10.

Referring now to FIG. 2, an automatic lock linkage 150 includes a lock drive link 152 that is attached to the backpost 102 at the pivot 108 shared with the connecting link 106. The lock drive link 152 extends downwardly to a pivot 156 with a locking link 154. The locking link 154 is attached to the upper mounting bracket 34 at a pivot 158. The locking link 154 includes a pocket 160 that is configured to receive a pin 26*a* on the rear glide link 26.

Figure 8:
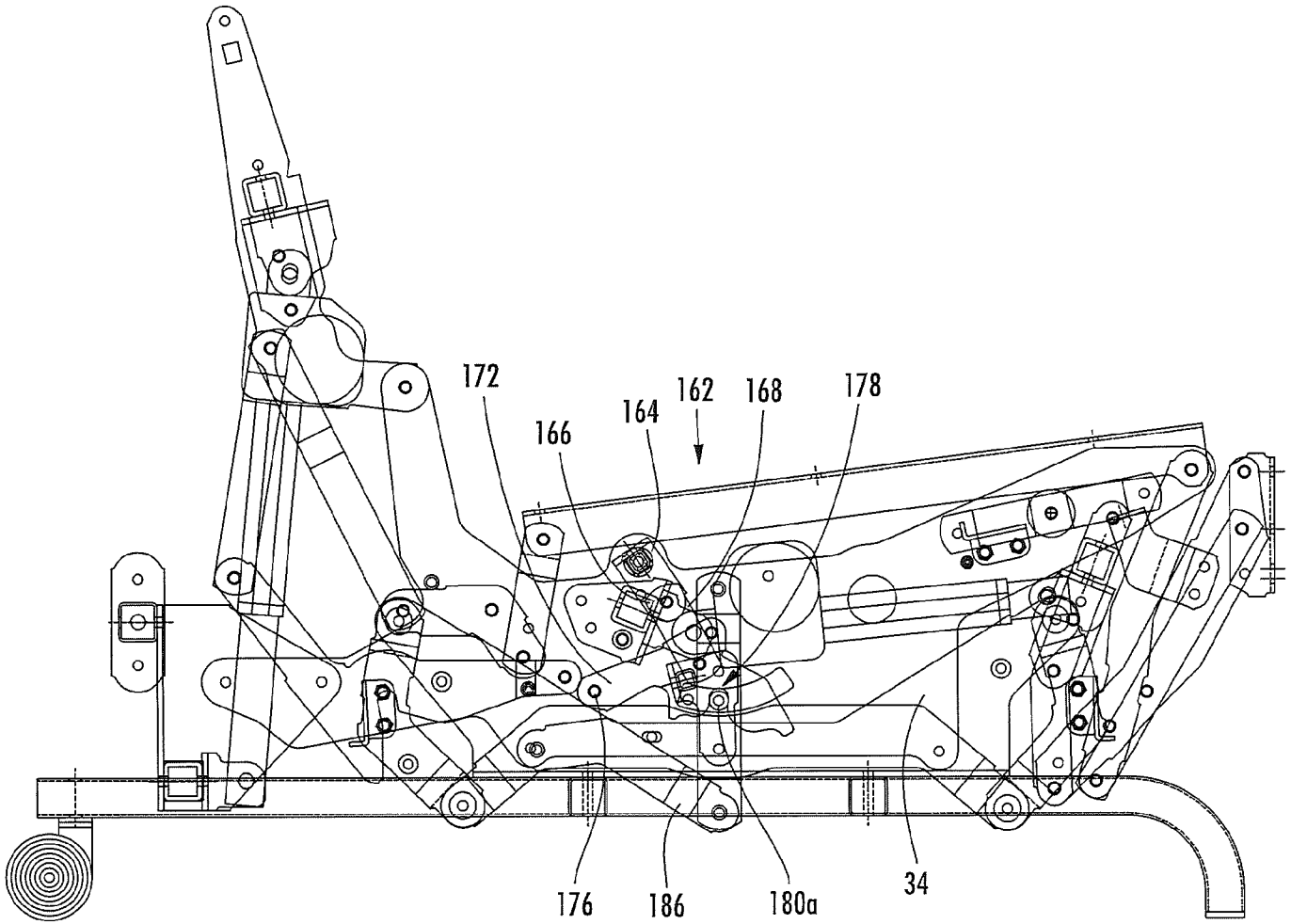
FIG. 8 is a side section view of the chair of FIG. 1 with the backrest in its upright position and the ottomans extended, wherein the chair is locked from gliding with the manual locking linkage.
Figure 9:
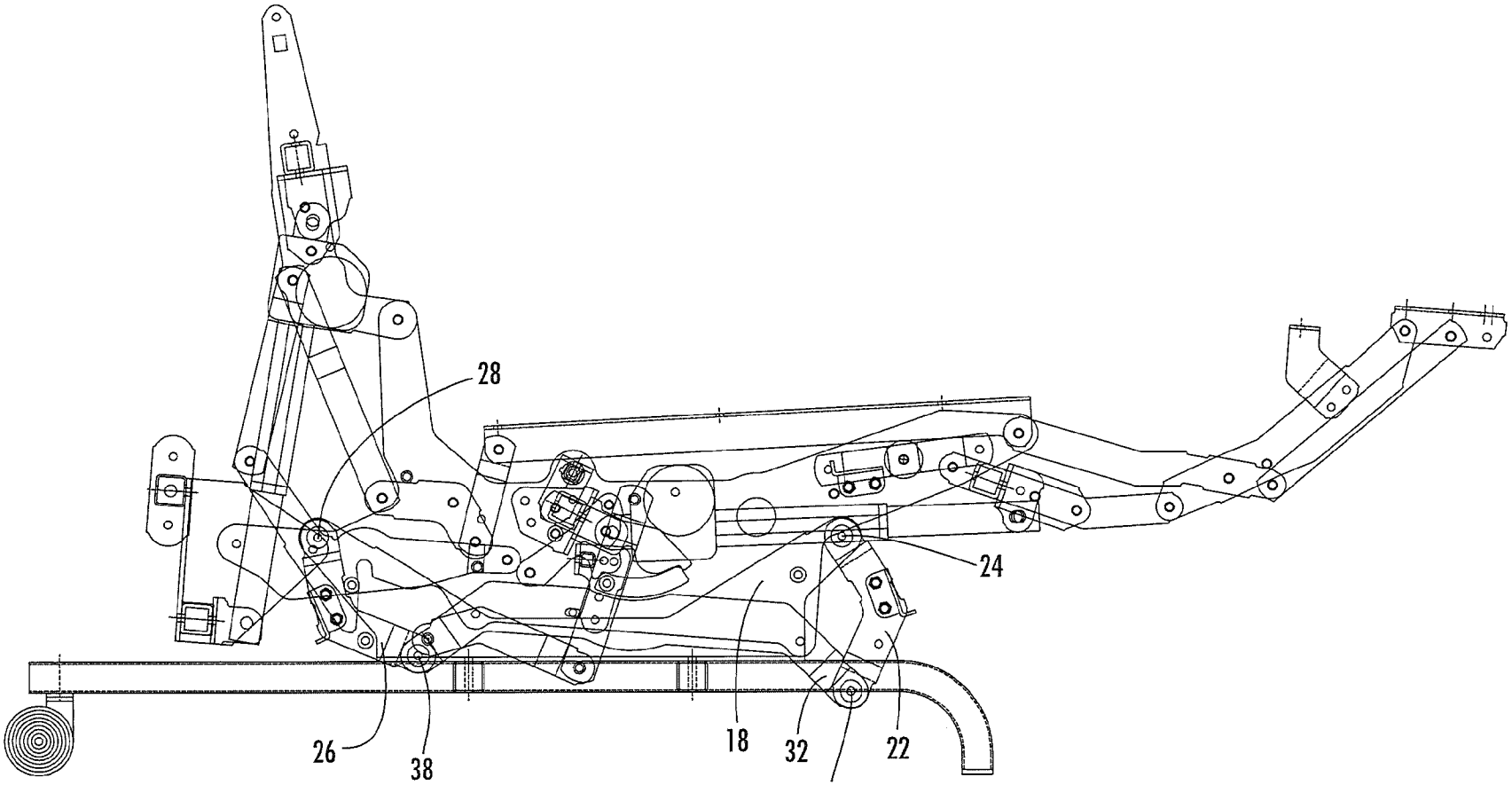
FIG. 9 is a side section view of the chair of FIG. 1 in a TV position and gliding forwardly.
Figure 10:
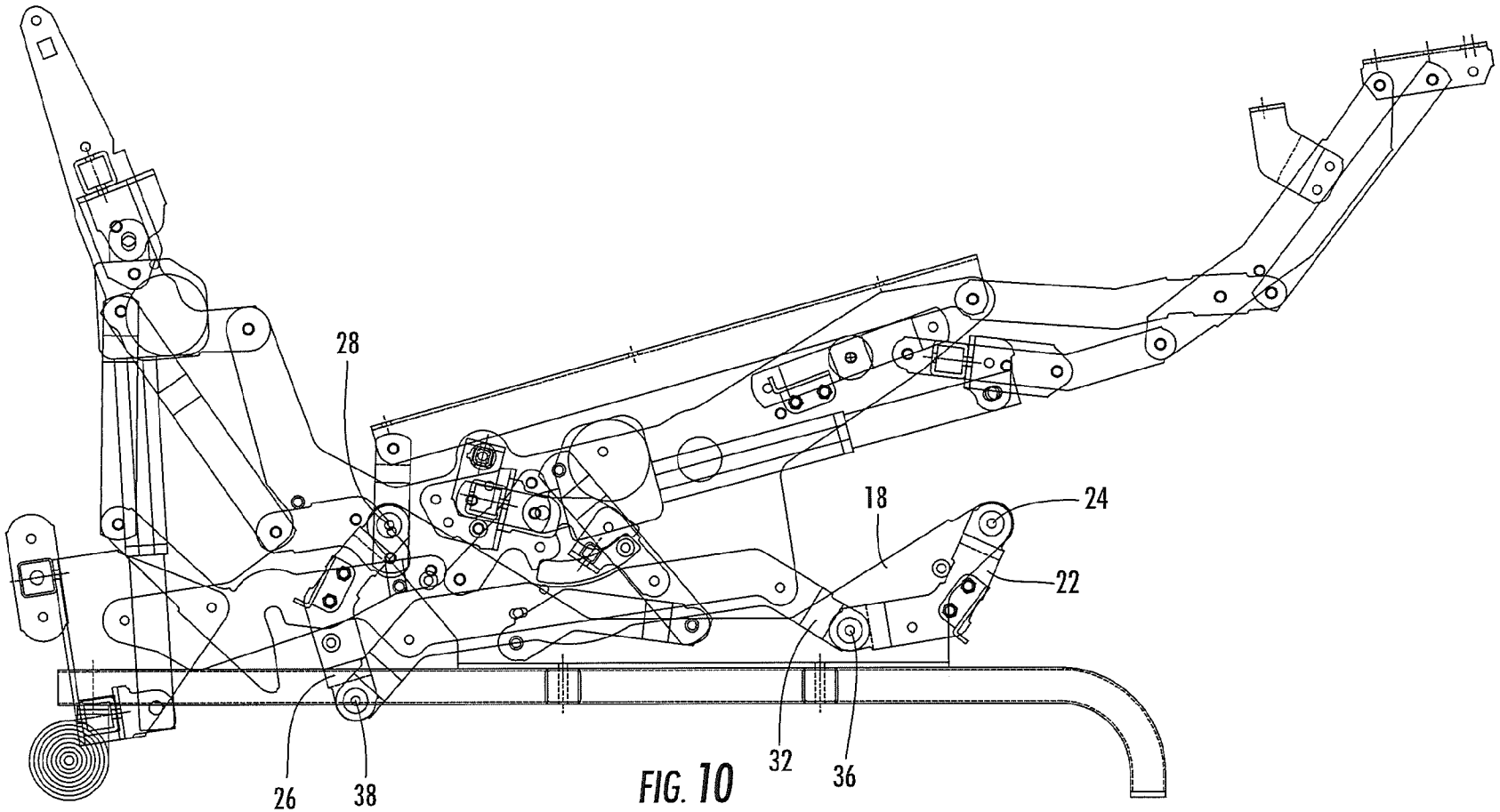
FIG. 10 is a side section view of the chair of FIG. 1 in a TV position and gliding rearwardly.

Referring again to FIG. 2 as well as FIG. 8, a manual lock linkage 162 includes an axle 164 that is attached to a handle (not shown) positioned outside of the arm of the chair 10. The axle 164 extends across the chair 10 and is mounted to brackets 166. Each bracket 166 is attached at a pivot 170 to a drive link 168. A locking link 172 is attached to the drive link 168 at a pivot 174 and to the upper mounting member 34 at a pivot 176. The locking link 172 includes a pocket 178. A stop link 180 with a pin 180*a* fixed thereto via a bracket 184 is attached to the upper mounting member 34 at a pivot 182. The pin 180*a* extends through an arcuate slot 34*a* in the upper mounting member 34. A control link 186 is attached to the glide mounting bracket 18 at a pivot 190 and to the lower end of the stop link 180 at a pivot 188.

To move the chair 10 from the TV position of FIG. 3 (with the backrest 15 upright and the ottomans 17*a*, 17*b* extended) to the upright position of FIG. 2, the occupant of the chair 10 activates the motor 72 of the ottoman drive unit 70 (typically via a push button, toggle switch or the like) to retract the rod 76 within the sleeve 74. As the rod 76 retracts, it draws the lower ottoman swing link 46 clockwise about the pivot 48. The movement of the lower ottoman swing link 46 pulls the upper ottoman extension link 50 downwardly and rearwardly, which in turn (a) draws the front ottoman bracket 60 downwardly and rearwardly and (b) rotates the upper ottoman swing link 42 clockwise about the pivot 44. The movement of the upper ottoman swing link 42 draws the lower ottoman extension link 56 downwardly and rearwardly, and the relative movement of the upper and lower ottoman extension links 50, 56 causes the front ottoman bracket 60 to rotate clockwise. Movement ceases when a pin 50*a* on the upper ottoman extension link 50 strikes an edge of the upper ottoman swing link 42 (see FIG. 2). In the retracted position, the front ottoman 17*a* is generally vertically disposed and positioned below the seat 13 to serve as the front panel of the chair 10, and the rear ottoman 17*b* is positioned rearwardly of the front ottoman 17*a* beneath the seat 13. The movement of the ottomans 17*a*, 17*b* via the ottoman linkage 40 is independent of any relative movement of the seat 13 and backrest 15.

In either of the upright or TV positions of FIGS. 2 and 3, the seat 13, backrest 15 and ottomans 17*a*, 17*b* are free to glide longitudinally relative to the base 12. The gliding action is provided by the gliding linkage 20; each of the front and rear glide links 22, 26 is free to pivot about, respectively, the pivots 24, 28. The pivoting action of the front and rear glide links 22, 26 allows the suspended lower and upper mounting members 32, 34, to which the seat 13, backrest 15 and ottomans 17*a*, 17*b* are connected via the reclining mechanisms 30, to glide longitudinally parallel to the rails 14 (see FIGS. 6 and 7, which illustrate the chair 10 with the ottomans 17*a*, 17*b* retracted in a forward gliding position and a rearward gliding position, and FIGS. 9 and 10, which illustrate the chair 10 with the ottomans 17*a*, 17*b* extended in forward and rearward gliding positions). As the chair 10 glides, the locking link 172 of the manual lock linkage 162 is free to rotate about the pivot 190, as the pin 180*a* slides within the slot 34*a* (FIGS. 6, 7, 9 and 10).

Figure 11:
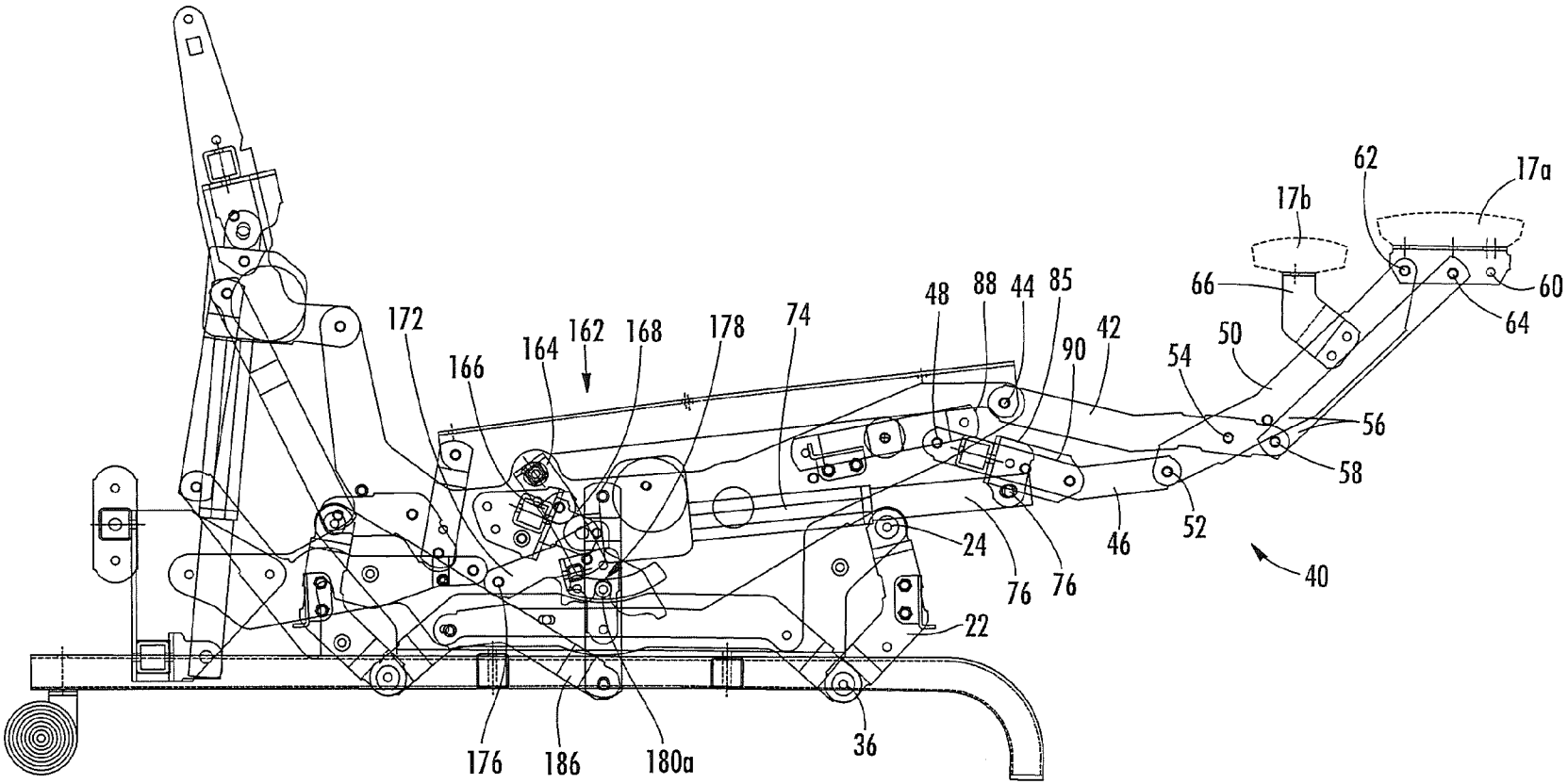
FIG. 11 is a side section view of the chair of FIG. 1 in a TV position, wherein the chair is locked from gliding with the manual locking linkage.

In the event that the occupant wishes to prevent the chair 10 from gliding in either the upright or TV position, the occupant can manually lock the chair 10 in place via the manual lock linkage 162. Manipulation of the handle by the occupant causes the axle 164 to rotate counterclockwise, which rotates the bracket 166 and forces the drive link 168 forward and down. This movement drives the locking link 172 clockwise about the pivot 176 until the pocket 178 captures the pin 180*a*. Capturing the pin 180*a* prevents the locking link 180 from moving relative to the control link 186 or the upper mounting member 34, thereby preventing the seat 13, the backrest 15 and the ottomans 17*a*, 17*b* from moving relative to the base 12. Manually locking can be performed with the chair 10 in either the upright position (FIG. 8) or in the TV position (FIG. 11).

To move the chair 10 from either the TV position or the upright position to the fully reclined position of FIG. 4, the occupant activates the motor 124 of the backrest power unit 122, which retracts the rod 128 within the sleeve 126. This motion draws the backpost 102 (and in turn the backrest 15) counterclockwise about the pivot 104. The movement of the backpost 102 forces the connecting link 106 downwardly, which action rotates the transition link 110 counterclockwise about the pivot 116. The rotation of the transition link 110 raises the seat elevation link 114, which in turn raises the rear end of the seat frame 118. Movement of the chair 10 ceases when edge of the connecting link 106 strikes a pin 34*b* on the upper mounting member 34.

When the chair 10 is fully reclined, the upper surfaces of backrest 15 and the seat 13 are generally coplanar (i.e., they are in a "lay-flat" condition), which may be suitable or desirable for health care patients and the like. In some embodiments, the upper surface of the backrest 15 forms an angle of between about 0 and 20 degrees with the underlying surface.

In addition, as the backpost 102 rotates, the lock drive link 152 is forced downwardly. This action rotates the locking link 154 counterclockwise about the pivot 158. The pocket 160 in the locking link 154 captures the pin 26*a* on the rear glide link 26. The inability of the rear glide link 26 to rotate relative to the lower mounting member 32 prevents the chair 10 from any gliding action automatically upon movement of the chair 10 to the fully reclined position. Automatic locking in the fully reclined position may be desirable in gliding chairs, particularly those chairs with lay-flat capability. Notably, automatic locking occurs whether the ottomans 17*a*, 17*b* are extended as in FIG. 4 or retracted.

Those skilled in this art will recognize that the chair may take other configurations. For example, the reclining mechanisms 30 may be replaced with a conventional "3-way mechanism" that moves between upright, TV and fully reclined positions, including those in which the ottoman linkage and backrest linkage are coupled. In some embodiments, the chair may take a more conventional fully reclined position rather than a lay-flat position. Other gliding mechanisms may also be employed.

Also, the configuration of the manual locking linkage may differ. For example, the handle may be replaced with another actuating member, such as a push button, release lever, or the like. The actuating member may be connected directly to the locking link. The bracket 184 that attaches the stop pin to the stop link may be omitted. The manual locking linkage may be configured to lock the chair in a locked position in which the seat is positioned more forward or rearward relative to the base. Further, the manual locking linkage may be configured to capture one of the front or rear glide links to lock the chair in place. Other modifications are also possible.

In addition, the configuration of the automatic locking linkage may differ. As an example, the automatic locking linkage may be driven by movement of a link other than the backpost, such as the seat frame or the seat elevation link. Like the manual locking linkage, the automatic locking linkage may be configured to lock the chair in a locked position in which the seat is positioned more forward or rearward relative to the base. In some embodiments, the automatic locking linkage may be configured to engage the front glide link rather than the rear glide link. Other modifications are also possible.

The foregoing embodiments are illustrative of the present invention, and are not to be construed as limiting thereof. Although exemplary embodiments of this invention have been described, those skilled in the art will readily appreciate that many modifications are possible in the exemplary embodiments without materially departing from the novel teachings and advantages of this invention. Accordingly, all such modifications are intended to be included within the scope of this invention as defined in the claims. The invention is defined by the following claims, with equivalents of the claims to be included therein.

That which is claimed is:

1. A gliding and reclining seating unit, comprising:

a base configured to reside on an underlying surface;

a generally horizontally-disposed seat positioned above the base;

a generally upright backrest positioned above the base and substantially rearward of the seat;

an extendable ottoman;

a reclining mechanism attached to the seat, the backrest, the ottoman and the base, the reclining mechanism comprising a plurality of pivotally interconnected links and including (a) an ottoman linkage configured to move the ottoman between a retracted position, in which the ottoman is generally vertically disposed and positioned below the seat, and an extended position, in which the ottoman is generally horizontally disposed in front of the seat, and further including (b) a backrest linkage configured to move the backrest and seat between an upright position, in which the seat is generally horizontally disposed and the backrest is generally vertically disposed, and a fully reclined position, in which the angle between the backrest and the seat increases;

a gliding mechanism attached to the base and the reclining mechanism, the gliding mechanism being configured to enable the seat, backrest and reclining mechanism to glide relative to the base along a longitudinal path responsive to a longitudinally-directed force; and a manually-operated lock linkage that moves between an unlocked condition, in which the linkage permits the seating unit to glide, and a locked condition, in which the seating unit is prevented from gliding; and an automatic lock linkage coupled to the reclining mechanism, the automatic lock linkage configured to move between an unlocked condition that allows the seating unit to glide when it is in the upright position and a locked condition that prevents the seating unit from gliding when it is in the fully reclined position;

wherein the manually-operated lock linkage is configured to move to the locked condition when the ottoman is in its extended position or in its retracted position.

2. The seating unit defined in claim 1, wherein the automatic lock linkage allows the seating unit to glide when the ottoman is extended.

3. The seating unit defined in claim 1, further comprising a first power unit connected with the reclining mechanism that moves the ottoman from the retracted position to the extended position.

4. The seating unit defined in claim 1, further comprising a second power unit connected with the reclining mechanism that moves the backrest from the upright position to the fully reclined position.

5. The seating unit defined in claim 1, wherein the automatic lock linkage comprises a locking link that is pivotally attached to the reclining mechanism, and wherein the gliding mechanism comprises a rear glide link that is pivotally attached to the base and to the reclining mechanism, and wherein in the locked condition the locking link engages a pin on the rear glide link.

6. The seating unit defined in claim 1, wherein the manually-operated lock linkage includes a control link pivotally attached to the base, a stop link pivotally attached to the control link and to the reclining mechanism, and a locking link pivotally attached to the reclining mechanism and to an actuating linkage, and wherein in the locked condition the locking link engages a pin fixed to the stop link.

7. The seating unit defined in claim 1, wherein a rear end portion of the seat rises relative to the base when the backrest moves from the upright position to the fully reclined position.

8. The seating unit defined in claim 1, wherein in the fully reclined position, the backrest defines an angle of between about 0 and 20 degrees with the underlying surface.

9. A gliding and reclining seating unit, comprising:

a base configured to reside on an underlying surface;

a generally horizontally-disposed seat positioned above the base;

a generally upright backrest positioned above the base and substantially rearward of the seat;

an extendable ottoman;

a reclining mechanism attached to the seat, the backrest, the ottoman and the base, the reclining mechanism comprising a plurality of pivotally interconnected links and including (a) an ottoman linkage configured to move the ottoman between a retracted position, in which the ottoman is generally vertically disposed and positioned below the seat, and an extended position, in which the ottoman is generally horizontally disposed in front of the seat, and further including (b) a backrest linkage configured to move the backrest and seat between an upright position, in which the seat is generally horizontally disposed and the backrest is generally vertically disposed, and a fully reclined position, in which the angle between the backrest and the seat increases;

a first power unit connected with the ottoman linkage that moves the ottoman from the retracted position to the extended position; and a second power unit connected with the backrest linkage that moves the backrest from the upright position to the fully reclined position;

a gliding mechanism attached to the base and the reclining mechanism, the gliding mechanism being configured to enable the seat, backrest and reclining mechanism to glide relative to the base along a longitudinal path responsive to a longitudinally-directed force; and a manually-operated lock linkage that moves between an unlocked condition, in which the linkage permits the seating unit to glide, and a locked condition, in which the seating unit is prevented from gliding;

an automatic lock linkage coupled to the reclining mechanism, the automatic lock linkage configured to move between an unlocked condition that allows the seating unit to glide when the backrest is in the upright position and a locked condition that prevents the seating unit from gliding when the backrest is in the fully reclined position;

wherein the automatic lock linkage comprises a locking link that is pivotally attached to the reclining mechanism, and wherein the gliding mechanism comprises a rear glide link that is pivotally attached to the base and to the reclining mechanism and wherein in the locked condition the locking link engages a pin on the rear glide link.

10. The seating unit defined in claim 9, wherein the automatic lock linkage allows the seating unit to glide when the ottoman is in the extended position.

11. The seating unit defined in claim 9, wherein the manually-operated lock linkage is configured to move to the locked condition when the ottoman is in either the retracted or the extended position.

12. The seating unit defined in claim 9, wherein the manually-operated lock linkage includes a control link pivotally attached to the base, a stop link pivotally attached to the control link and to the reclining mechanism, and a locking link pivotally attached to the reclining mechanism and to an actuating linkage, and wherein in the locked condition the locking link engages a pin fixed to the stop link.

13. The seating unit defined in claim 9, wherein a rear end portion of the seat rises relative to the base when the backrest moves to the fully reclined position.

14. The seating unit defined in claim 9, wherein in the fully reclined position, the backrest defines an angle of between about 0 and 20 degrees with the underlying surface.

15. A gliding and reclining seating unit, comprising:

a base configured to reside on an underlying surface;

a generally horizontally-disposed seat positioned above the base;

a generally upright backrest positioned above the base and substantially rearward of the seat;

an extendable ottoman;

a reclining mechanism attached to the seat, the backrest, the ottoman and the base, the reclining mechanism comprising a plurality of pivotally interconnected links and including (a) an ottoman linkage configured to move the ottoman between a retracted position, in which the ottoman is generally vertically disposed and positioned below the seat, and an extended position, in which the ottoman is generally horizontally disposed in front of the seat, and further including (b) a backrest linkage configured to move the backrest and seat between an upright position, in which the seat is generally horizontally disposed and the backrest is generally vertically disposed, and a fully reclined position, in which the angle between the backrest and the seat increases;

a gliding mechanism attached to the base and the reclining mechanism, the gliding mechanism being configured to enable the seat, backrest and reclining mechanism to glide relative to the base along a longitudinal path responsive to a longitudinally-directed force; and a manually-operated lock linkage that moves between an unlocked condition, in which the linkage permits the seating unit to glide, and a locked condition, in which the seating unit is prevented from gliding; and an automatic lock linkage coupled to the reclining mechanism, the automatic lock linkage configured to move between an unlocked condition that allows the seating unit to glide when it is in the upright position and a locked condition that prevents the seating unit from gliding when it is in the fully reclined position;

wherein a rear end portion of the seat rises relative to the base when the backrest moves to the fully reclined position; and wherein in the fully reclined position, the backrest defines an angle of between about 0 and 20 degrees with the underlying surface.

16. The seating unit defined in claim 15, wherein the automatic lock linkage allows the seating unit to glide when the ottoman is in the extended position.

17. The seating unit defined in claim 15, wherein the manually-operated lock linkage is configured to move to the locked condition when the ottoman is in either the retracted or the extended position.

18. The seating unit defined in claim 15, further comprising a first power unit connected with the reclining mechanism that moves the ottoman from the retracted position to the extended position.

19. The seating unit defined in claim 15, further comprising a second power unit connected with the reclining mechanism that moves the backrest from the upright position to the fully reclined position.

20. The seating unit defined in claim 15, wherein the automatic lock linkage comprises a locking link that is pivotally attached to the reclining mechanism, and wherein the gliding mechanism comprises a rear glide link that is pivotally attached to the base and to the reclining mechanism, and wherein in the locked condition the locking link engages a pin on the rear glide link.

21. The seating unit defined in claim 15, wherein the manually-operated lock linkage includes a control link pivotally attached to the base, a stop link pivotally attached to the control link and to the reclining mechanism, and a locking link pivotally attached to the reclining mechanism and to an actuating linkage, and wherein in the locked condition the locking link engages a pin fixed to the stop link.

22. A gliding and reclining seating unit, comprising:

a base configured to reside on an underlying surface;

a generally horizontally-disposed seat positioned above the base;

a generally upright backrest positioned above the base and substantially rearward of the seat;

an extendable ottoman;

a reclining mechanism attached to the seat, the backrest, the ottoman and the base, the reclining mechanism comprising a plurality of pivotally interconnected links and including (a) an ottoman linkage configured to move the ottoman between a retracted position, in which the ottoman is generally vertically disposed and positioned below the seat, and an extended position, in which the ottoman is generally horizontally disposed in front of the seat, and further including (b) a backrest linkage configured to move the backrest and seat between an upright position, in which the seat is generally horizontally disposed and the backrest is generally vertically disposed, and a fully reclined position, in which the angle between the backrest and the seat increases;

a gliding mechanism attached to the base and the reclining mechanism, the gliding mechanism being configured to enable the seat, backrest and reclining mechanism to glide relative to the base along a longitudinal path responsive to a longitudinally-directed force; and a manually-operated lock linkage that moves between an unlocked condition, in which the linkage permits the seating unit to glide, and a locked condition, in which the seating unit is prevented from gliding; and an automatic lock linkage coupled to the reclining mechanism, the automatic lock linkage configured to move between an unlocked condition that allows the seating unit to glide when the backrest is in the upright position and a locked condition that prevents the seating unit from gliding when the backrest is in the fully reclined position;

wherein the manually-operated lock linkage is configured to move to the locked condition when the ottoman is in its extended position or in its retracted position.

* * * * *